United States Patent [19]

Knudsen

[11] 4,095,390

[45] Jun. 20, 1978

[54] MACHINE AND PROCESS FOR CAPPING AND SEALING CONTAINERS

[75] Inventor: David S. Knudsen, St. Louis, Mo.

[73] Assignee: McKenna Equipment Company, Inc., Pacific, Mo.

[21] Appl. No.: 672,719

[22] Filed: Apr. 1, 1976

[51] Int. Cl.[2] ..... B65B 51/16; B65B 51/18; B65B 51/22; B65B 51/32

[52] U.S. Cl. ..... 53/39; 53/314; 53/300; 53/316; 53/373; 156/69; 156/272; 156/380; 198/626

[58] Field of Search ..... 53/39, 373, 313, 314, 53/315, 316, 282, 300, 112 R, 44; 219/10.53, 10.49; 336/75, 87, 73, 79, 82, 232; 156/69, 272, 380; 198/626, 627, 628

[56] References Cited

U.S. PATENT DOCUMENTS

| | | | |
|---|---|---|---|
| 2,618,425 | 11/1952 | Stover | 53/314 X |
| 2,631,642 | 3/1953 | Richardson et al. | 156/69 |
| 2,937,481 | 5/1960 | Palmer | 53/39 |
| 3,006,455 | 10/1961 | Dudnick | 198/626 X |
| 3,108,682 | 10/1963 | Zipper | 198/626 X |
| 3,179,237 | 4/1965 | Ninneman | 198/626 X |
| 3,186,142 | 6/1965 | Borgardt et al. | 53/373 |
| 3,332,209 | 7/1967 | Knudsen | 53/313 |
| 3,350,842 | 11/1967 | Renish | 53/316 |
| 3,454,142 | 7/1969 | Holstein | 198/626 |
| 3,694,609 | 9/1972 | Kennedy | 219/10.53 X |
| 3,748,422 | 7/1973 | Schafer | 219/10.53 |
| 3,767,076 | 10/1973 | Kennedy | 156/69 X |
| 3,875,725 | 4/1975 | Carmichael | 53/300 X |
| 3,878,874 | 4/1975 | Heckmann | 53/112 R X |
| 3,909,326 | 9/1975 | Renck | 53/39 X |

*Primary Examiner*—Othell M. Simpson

*Assistant Examiner*—Horace M. Culver

*Attorney, Agent, or Firm*—Gravely, Lieder & Woodruff

[57] ABSTRACT

A machine for applying lids to containers and for further heat sealing a metal foil membrane to each container beneath its lid includes a main conveyor and a timing screw at the feed end of the conveyor for releasing open top containers onto the conveyor at equally spaced intervals. As the containers move along the main conveyor, captivator blocks, which are carried on synchronized chains located at each side of the main conveyor, converge toward and close upon the side walls of the containers so as to confine the containers in the horizontal direction while they move along the main conveyor. Lids are applied to the containers at a lid applicator while the containers are gripped by the captivator blocks. Thereafter the containers pass beneath an overhead belt and the lower pass of this belt is backed by a pair of skid plates and a plurality of rollers, with the rollers being interposed between the two skid plates. An induction coil creates a magnetic field beneath the rollers, and this field is of sufficient intensity to elevate the temperature of each foil membrane to above the point at which the membrane will bond to the rim of its container. As each container passes beneath the first skid plate, the force applied to the lid squeezes the membrane against the container rim with a constant force and excludes foreign particles from the interface. Thereafter the membrane is heated and as it is heated, the rollers apply an undulating force to the membrane, causing the heated membrane to seal snugly against the rim of the container. Finally the second skid plate applies a constant force to the membrane and holds it down against the container rim, allowing the membrane to bond to the rim as the membrane cools.

33 Claims, 9 Drawing Figures

MACHINE AND PROCESS FOR CAPPING AND SEALING CONTAINERS

BACKGROUND OF THE INVENTION

This invention relates in general to the sealing of containers, and more particularly to a machine and process for heat sealing membranes to containers.

It is most important to have food containers tightly sealed so as to prevent infestation by microorganisms. One of the more common means for obtaining a tight seal is the common screw cap which is run down tightly against the upper rim of the container to which it is applied, thus forming secure seal at that point. However, the screw provides a spiral path along which microorganisms migrate to the periphery of the seal, so that once the cap is removed, the microorganisms have little difficulty migrating the rest of the way into the interior of the container. Furthermore, screw caps are difficult to handle and must be twisted in order to be applied. This requires complicated and expensive machinery. Often, the machinery applies too much torque to the cap, making the caps extremely difficult to remove.

Plastic lids which snap onto the upper rims of their containers are a relatively recent innovation which has gained considerable popularity in connection with butter, margarine and other spreads which are normally sold in plastic tubs. These snap-type lids are relatively easy to apply and the containers themselves do not have spiral paths along which microorganisms can migrate. Furthermore, the snap lids are easily removed.

It is not uncommon to interpose a membrane-type seal between the rim of the container and the top of the lid, whether the latter be a snap lid or a screw lid. This seal accommodates for irregularities in the opposing surfaces of the container rim and screw cap, and usually remains in place after the lid is removed, thus preventing unauthorized sampling from store shelves. Some of these membrane seals are even heat sealed to their containers to insure against infestation and unauthorized sampling. The usual procedure for obtaining a heat seal is to place a foil coated with a heat sensitive adhesive over the rim of the container and then apply pressure to the foil with a heated platen. The heat is transferred to the foil by conduction and activates the adhesive.

Where the container is formed from a flexible plastic and has a relatively large top as is the case with a margerine tub, the seal must be applied while the plastic lid is on the container since without the lid, the axial sealing force applied to the foil to seal it will distort the container into an elliptical configuration which does not match the circular shape of the foil membrane. In other words, the cap confines the container at its upper rim and thereby enables the container to maintain its shape in the presence of the force. However, most plastic lids will not conduct sufficient heat at low temperatures to activate the heat sensitive adhesive on the foil. Of course, when the temperature is elevated high enough to insure good transmission, the heat will destroy the plastic lid.

Heretofore, the seal membranes have been inductively heated by passing the containers with the seal membranes and lids in place through a magnetic field while rotating the containers to insure even heating of the foil membranes. This is a slow and complicated procedure which is not compatible with high speed filling and capping lines.

SUMMARY OF THE INVENTION

One of the principal objects of the invention is to provide an apparatus and process for applying metal foil membranes to containers to seal the open tops of such containers. Another object is to provide an apparatus and process of the type stated which is ideally suited for applying heat seals to flexible thin wall containers capped with flexible plastic lids. A further object is to provide an apparatus and process of the type stated in which the force necessary to secure the metal foil as it is heated is applied through a flexible plastic lid. An additional object is to provide an apparatus and process of the type stated in which the foil membrane is inductively heated without rotating the container. Still another object is to provide an apparatus and process of the type stated in which the containers are sealed at high speeds in excess of 300 containers per minute. Yet another object is to provide an apparatus and process of the type stated in which the force is applied in an undulating or intermittent manner. A further object is to provide an apparatus and process of the type stated in which the containers are maintained at equally spaced intervals as the foil membranes within them are inductively heated. These and other objects and advantages will become apparent hereinafter.

The present invention is embodied in a machine including a conveyor, means for spacing containers at equal intervals along the conveyor, an induction coil for heating metal seal members which are placed over the rims at the open tops of the containers, and means forcing the seal members against the container rims. The invention further resides in the sealing process which takes place on the machine. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
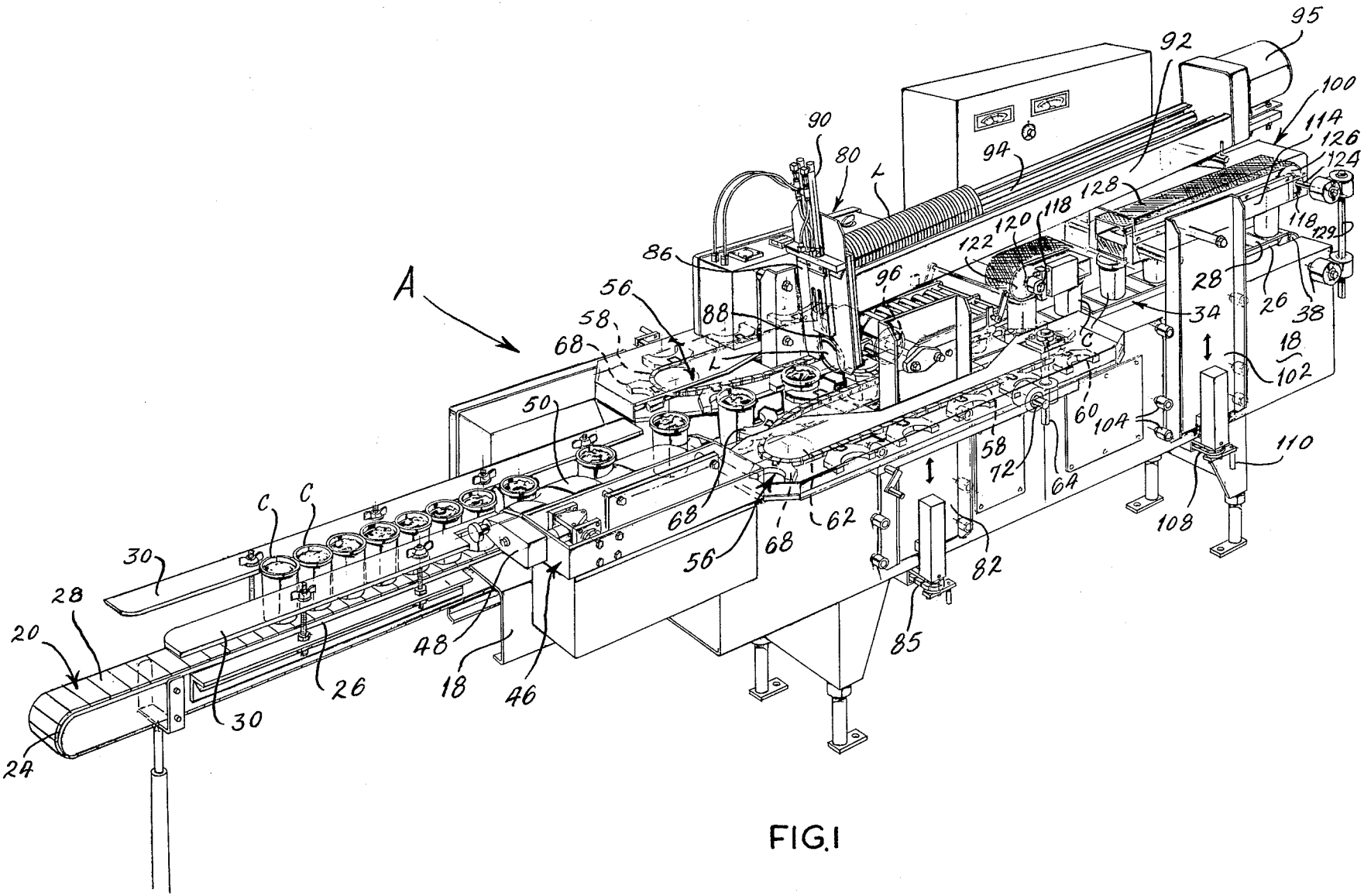
FIG. 1 is a perspective view of a machine constructed in accordance with the present invention for applying lids to containers and heat sealing membranes to the containers beneath the lids.

Referring now to the drawings (FIG. 1), A designates a machine which applies lids L to container C (FIG. 2) and heat seals a foil membrane M to the container C beneath the lid L so that if the lid L is removed, the contents of the container C are still protected by the foil membrane M. The containers C are molded from somewhat flexible plastic material such as polyethylene, and each container C has a circular side wall 2 and an open top surrounded by a rim 4. The upwardly presented surface of the rim 4 is rounded to both the inside and outside of the container C, and the foil membrane M seals against the rounded surface of the rim 4. Moreover, the rim 4 projects laterally beyond the side wall 2.

The lid L (FIG. 2) is molded from a relatively flexible plastic, such as polyethylene, and is for the most part flat. At its periphery, the lid L has a downwardly directed flange 6, the diameter of which is such that when the flange 6 is stretched slightly it will fit over the outside of the outwardly directed rim 4 on the container C. The flange 6 carries an inwardly directed lip 8, which when the lid L is fully in place on the container C, fits beneath the outwardly directed rim 4. This interlocks the lid L with the rim 4 and maintains the lid L firmly in place in a positive manner. Directly opposite the curved surface of the rim 6, the lid L has an annular recess 10 in which the upper portion of the rim 6 is received, and on its opposite surface the lid L is provided with an embossment in the form of an annular rib 12. The upper surface of the rib 12 is planar.

The foil membrane M (FIG. 2) fits over the open top of the container C and as such lies against the inside face of the lid L. Near its periphery, the foil membrane M is distorted into the recess 10, and hence this portion of the membrane M curves over the rounded surface on the rib 12. The diameter of the membrane M is greater than the inside diameter of the lip 8 so that once the membrane M is forced into the lid L, it will be retained in place by the flange 6. The foil membrane M may be a laminate comprised of metal foil on the side presented toward the interior of the container and paper on the opposite side. The portion of the foil layer which overlies the curved surface of the rim 8 may be provided with a thin coating of the same material from which the container C is made, that is polyethylene. Likewise, it may be coated with a heat sensitive adhesive. The metal foil may be aluminum, although practically any metal which is compatible with the contents of the container C is acceptable.

The capping machine A includes (FIGS. 1, 3 and 4) a main frame 18 which supports a main conveyor 20 onto which filled containers C are placed at random spacing. The conveyor 20 extends the full length of the frame 18 and includes a drive sprocket 22 (FIG. 3) and an idler sprocket 24 with parallel skid plates 26 being extended between the two sprockets 22 and 24. Passing over the sprockets 22 and 24 is a table top chain 28, the individual links of which are formed from plastic plates connected together by pins. These links mesh with the sprockets 22 and 24 to insure a positive drive. The upper pass of the chain 28 is supported on the skid plates 26 which maintain that pass perfectly flat. Along each side of the chain 28 at its feed end are guide members 30 which are elevated slightly above the upper pass of the chain 28. The spacing between the guide members 30 is slightly greater than the diameter of the containers C so that the guide members 30 maintain the container C in single file as they pass along the feed end of the main conveyor 20. The drive sprocket 22, which is at the opposite or discharge end of the conveyor 20, is mounted on a powered drive shaft 32.

Figure 2:
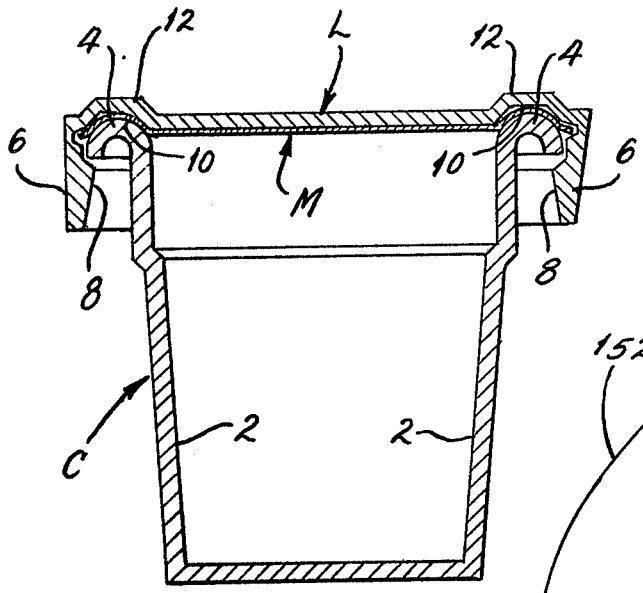
FIG. 2 is a sectional view of a typical container which is capped and sealed in the machine of the invention.
Figure 4:
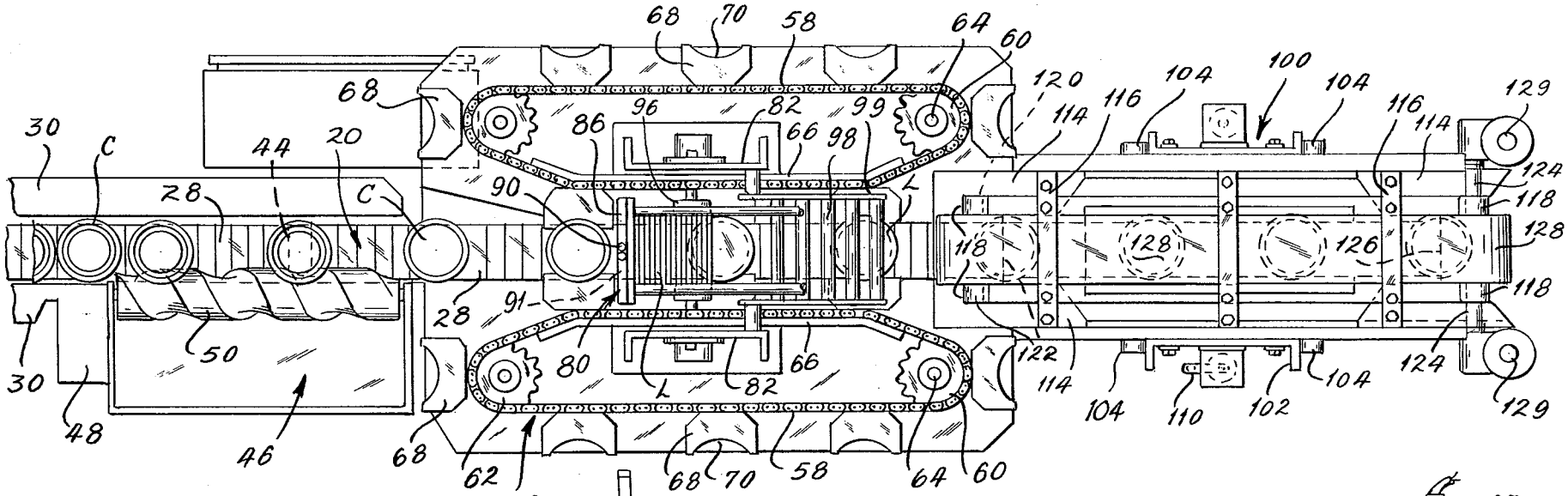
FIG. 4 is a sectional view taken along line 4—4 of FIG. 3 and showing the major portion of the machine in plan.
Figure 3:
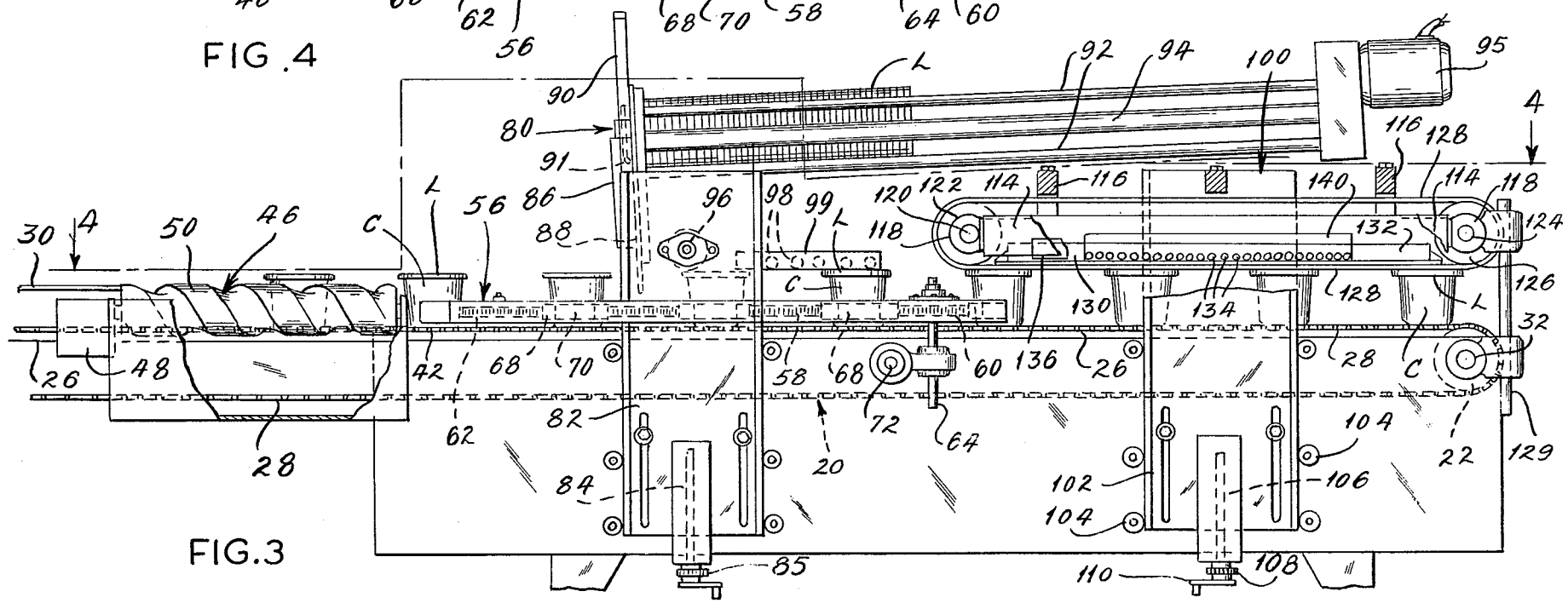
FIG. 3 is a side elevational view of the machine.

One of the guide members 30 at the feed end of the conveyor 20 is substantially longer than the other, and this guide member 30 is located opposite a spacing mechanism 46 (FIGS. 1, 3 and 4). The other guide member 30 extends up to and terminates at the spacing mechanism 46. The spacing mechanism 46 is attached firmly to the frame 18, and includes a timing screw 50, the axis of rotation for which is parallel to the guide member 30. The screw 50 actually is a continuation of the short guide member 30 and as such is located opposite to the longer guide member 30. The root of the screw 50 is of substantially constant size and that size is large enough to accommodate a small segment of the side wall 2 on one side of a container C, while the other side of the side wall 2 for the container C is against the longer of the two guide members 30. The pitch of the screw 50 however varies with the region of smallest pitch being toward the feed end and the region of largest pitch being toward the discharge end. The pitch increases progressively from the feed end and to about within 6 inches of the discharge end, after which the pitch is constant. Moreover, at the region of smallest pitch, the pitch is such that the screw 50 will pick up containers C which are in contact with each other. At the other end, the pitch is such that containers C are spaced apart a distance suitable for capping as will be described in greater detail. Thus, as the screw 50 of the spacing mechanism 46 transfers the containers C along the main conveyor 20, the containers C are accelerated until the region of constant pitch is reached. Moreover, the screw 50 is rotated at a speed which enables it to discharge the accelerated containers C at substantially the same velocity as the chain 28 of the main conveyor 20. Since the chain 28 is a succession of plastic plates, those plates merely slide beneath the containers C, should the containers C become stacked at the feed end of the timing screw 50. Hence, the containers C, after passing beyond the screw 50, are generally equally spaced along the main conveyor 20.

The portion of the main conveyor 20 located immediately beyond the spacing mechanism 46 passes beneath a captivator assembly 56 (FIGS. 1, 3 and 4) which includes a pair of roller chains 58 on each side of the conveyor chain 28. Each roller chain 48 is trained around (FIG. 4) a drive sprocket 60 and in idler sprocket 62 with the former being located ahead of the latter. Both sprockets 60 and 62 rotate about vertical axes, with the drive sprocket 60 being mounted on a vertical drive shaft 64. The two sprockets 60 and 62 are set back somewhat from the conveyor chain 28, and between the two sprockets 60 and 62 the inside pass of the roller chain 58 extends along a backing bar 66 which prevents the roller chain 58 from moving away from the conveyor chain 28. The central portion of the bar 66 parallels the conveyor chain 28, while the end portions diverge away from the chain 28 toward the sprockets 60 and 62. The roller chain 58 carries captivator blocks 68 which are fastened to it at equally spaced intervals, and these blocks 68 are located on the outside of the chain 58 so as not to interfere with the sprockets 60 and 62. Each block 68 has a concave face 70 which is presented away from the chain 58 and has the same curvature as the side walls 2 of the containers C.

The drive shafts 64 for the two roller chains 58 on each side of the main conveyor chain 28 are tied together by a cross shaft 72 such that the two chains 58 move in unison at the same velocity. One of the shafts 64 is mechanically connected to the drive mechanism for the main conveyor chain 28. The connection is such that the inner passes for the two chains 58 move in the same direction as the upper pass of the main conveyor chain 28 and at about the same velocity. Furthermore, the cross shaft 72 synchronizes the two chains 58 so that the captivator blocks 68 on them are located directly opposite each other when adjacent to the belt 42. When the blocks 68 are so disposed, the spacing between any two opposed blocks 68 equals the diameter of containers C so that a container C may be captured between each pair of opposed blocks. Not only are the two chains 58 synchronized with each other, but they are also synchronized with the timing screw 50 of the spacing mechanism 46, the synchronization being such that a container C upon being released onto the chain 28 by the screw 50 will, as it moves with the chain 28, come between two opposed captivator blocks 68 as those blocks close upon each another. In other words, as the pairs of captivator blocks 68 converge beyond the idler sprockets 60, the main conveyor chain 28 will move a container C in between the concave surfaces 70 of the blocks 68, the container C having been precisely portioned on the chain 28 by the screw 50. Thus as the containers C move through the captivator assembly 56 they are captured between the captivator blocks 68 which hold the containers C at a precise position on the chain 28 and prevent them from being toppled. Therefore in the region of the captivator assembly 56, both the captivator assembly 56 and the main conveyor 20 move the containers C, and the two may be considered conveyor means. As the captivator blocks 68 move toward their respective drive sprockets 60 they diverge and release the containers C, but the containers C continue to move at the same velocity inasmuch as they are supported on the chain 28.

Located at the captivator assembly 56 is a lid applicator 80 (FIGS. 1 and 3) which applies the lids L to the containers C as they pass through the captivator assembly 56, that is as they are gripped by the captivator blocks 68. The lid applicator 80 includes supporting legs 82 which straddle the main frame 18 and project upwardly through the captivator assembly 56. The legs 82 are adjustable upwardly and downwardly by jack screws 84, one of which is provided with a hand crank. The two jack screws 84 are tied together by a roller chain 85 so that when the hand crank is turned, the screws 84 rotate in unison. The legs 82 carry a lid delivery head 86 which is located above the captivator assembly 56 and has a delivery channel 88 which extends downwardly toward the belt 42. The head 86 is located just beyond the position where the opposed captivator blocks 68 first assume their completely closed positions. The channel 88 is just wide and deep enough to accommodate a single lid L. Mounted on the upper end of the delivery head 86 is a pair of double acting air cylinders 90, the piston rods of which align with and move through the delivery channel 88. Indeed, each piston rod is fitted with a presser finger 91, which, when the cylinder 90 is energized, moves through the channel 88 and toward the main conveyor chain 28.

The lid applicator 80 further includes a lid supply trough 92 (FIGS. 1 and 3) which is located above the conveyor chain 28 and is inclined downwardly at a slight angle toward the delivery head 86. The trough 92 has rods 94 along its side, and these rods 94 are revolved at about 1000 rev/min by a motor 95 located at the end of the trough 92. The lids L, containing the foil membranes M, are placed in the trough 92 with the flanges 6 projecting toward the delivery head 86. The flanges 6 come against the rotating rods 94 which spin the lids L and cause them to migrate toward the delivery head 96. The leading lid L will move into the upper end of the delivery channel 88, in which case the lower portion of its flange 6 will be disposed adjacent to the presser finger 91 of one of the air cylinders 90. When that air cylinder 90 is energized, the presser finger 91 moves downwardly and drives the leading lid L through the delivery channel 88. The presser finger 91 of the other cylinder 90 retracts. When that air cylinder 90 is energized, its presser finger 91 engages the flange 6 on the second lid L and pushes the second lid L through the channel 88, and the second lid in turn drives the first lid L still further through channel 88, placing it in a position in which the lowermost portion of its flange 6 is out of the channel 88 and disposed slightly below the rims 4 on the containers C which are moving along the main conveyor chain 28 (FIG. 1). In other words, the air cylinders 90 position the lower ends of the lids L in the path of the containers C moving on the chain 28. Thus, two opposed captivator blocks 68 will bring a container C against a lid L which is projecting out of the channel 88 of the head 86 so that the flange 6 of that lid L engages the rim 4 of the container C. Continued movement of the container C withdraws the engaged lid L from the delivery channel 88, and the lid L is placed onto the container C, covering the open top thereof. The operation of the lid applicator 80 is very similar to the lid applicator of U.S. Pat. No. 3,332,209.

Immediately beyond the delivery head 86 is a powered roller 96 which rotates on bearings on the legs 82. The roller 96 is connected to the driving mechanism for the main conveyor chain 28 and captivator chains 58, and its peripheral velocity is slightly less than the velocity of the captivator blocks 68. After each lid L drops onto the rim 4 of its container C, the container C is carried beneath the roller 96 which partially presses the lid L downwardly. Thereafter the containers C pass beneath a series of smaller compression rollers 98, the ends of which rotate freely in side plates 99 which are extended from the legs 82. The free wheeling compression rollers 98 force each lid L downwardly, causing its flange 6 to pass fully over the container rim 4 so that its inwardly directed lip 8 interlocks with the outwardly projecting rim 4. At the powered roller 96 and compression rollers 98, the containers C are captured between the captivator blocks 68 so that they continue to move with the main conveyor belt 42 upon encountering the rollers 96 and 98. After passing beyond the rollers 96 and 98 the captivator blocks 68 diverge, but the containers C continue to be transported by the main conveyor chain 28.

Beyond the captivator assembly 56 and the lid applicator 80, the main conveyor chain 28 passes beneath a heat sealing assembly 100 (FIG. 1) which heats the foil membrane M and bonds it to the upper surface of the rim 4 on the container C. The major portion of the heat sealing assembly 100 is disposed between the trough 92 of the lid applicator 80 and the belt 42 of the main conveyor 34.

The heat sealing assembly 100 includes a pair of legs 102 (FIGS. 1 and 3) which extend downwardly along each side of the main frame 18. Each leg 102 is located between a series of guide rollers 104 which project laterally from the frame 18. At their lower ends, the legs 102 are supported on screws 106 and the two screws 106 are tied together by a roller chain 108 which passes beneath the main frame 18. At least one of the screws 106 is provided with a hand crank 110 at its lower end. When the crank 110 is turned, the two screws 106 rotate in unison and this elevates or depresses the legs 102.

Figure 5:
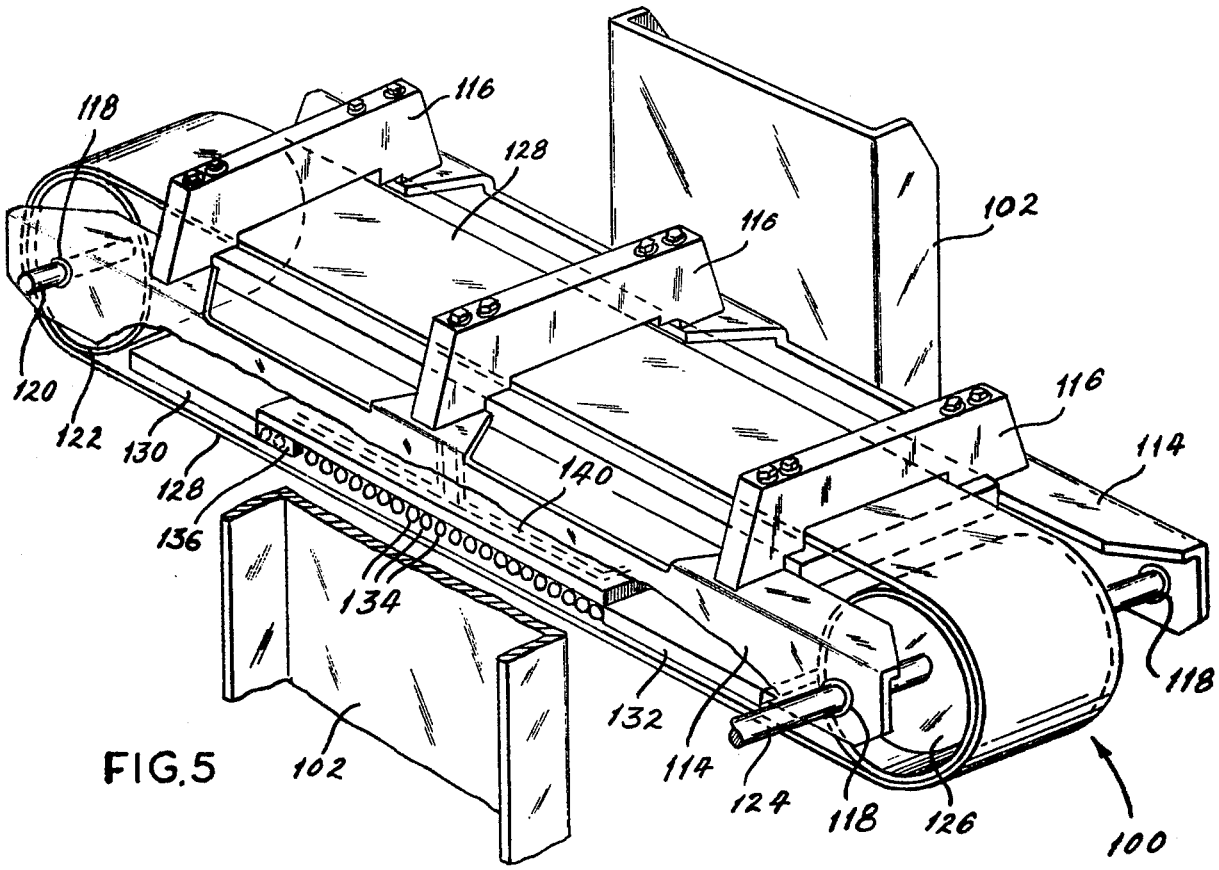
FIG. 5 is a perspective view partially broken away and in section of the heat sealing assembly of the machine.

The legs 102 at their upper ends support a pair of longitudinal side members 114 which are connected by cross members 116 (FIG. 5). The longitudinal members 114 have bearings 118 at their ends, and the bearings 118 closest to the captivator assembly 56 receive an idler shaft 120 on which an idler roller 122 is mounted, while the bearings 118 at the other end receive a drive shaft 124 on which a drive roller 126 is mounted. Passing around the rollers 122 and 126 is a flat highly flexible belt 128 which is preferably not greater than about 1/32 inches in thickness. The belt 128 is preferably formed from a durable plastic in which polyester cords are embedded to prevent the belt 128 from stretching. The idler roller 122 is located far enough rearwardly to enable the lids L of containers C to be engaged by the lower pass 128 of the flexible belt 128 before the containers C are completely released by the captivator blocks 68. More particularly, the captivator blocks 68 tend to push the containers C beneath the belt 128 as those blocks diverge toward their drive sprockets 68.

The drive shaft 124 projects laterally beyond the bearing 118 in which it is received, and each end of the shaft 124 is connected to the drive shaft 32 for the drive sprocket 22 of the main conveyor 20 through two right angle drives and vertical transfer shafts 129 (FIGS. 1, 3 and 4). The transfer shaft 129 is splined or keyed so that it may move upwardly and downwardly through the lower of the two right angle drives when the hand crank 110 is turned to elevate or depress the heat sealing assembly 100. The mechanical connection between the two drive rollers 38 and 124 is such that the lower pass of the belt 128 travels in the same direction and at the same velocity as the upper pass of the main conveyor chain 28. Immediately beyond the idler roller 122 the belt 128 passes under a skid plate 130 (FIGS. 3 and 5) which is fastened to the longitudinal side members 114, bridging the space between them. Similarly, immediately prior to the drive roller 126 the belt 128 passes under another skid plate 132 which likewise is attached to the two longitudinal side members 114. The undersides of the two plates 130 and 132 are perfectly flat and coplanar, that plane being tangent to the bottom surfaces of the idler and drive rollers 122 and 126. The area immediately below the first skid plate 130 is called a prepressing zone and its length should be about 1.5 times the diameter of the lid L. The area immediately below the skid plate 132 is called cooling zone and its length is about twice the diameter of the lid L. Thus, the belt 128 as it passes through the prepressing and cooling zones is maintained perfectly flat at a predetermined elevation above the main conveyor belt 42. That elevation could be between 1/64 and ⅛ inches less than the maximum height of the container C with the lid L seated upon it (the distance from the top surface of the annular rib 12 on the lid to the bottom surface of the container C).

The space between the two skid plates 130 and 132 is occupied by a plurality of pressing rollers 134 (FIGS. 3 and 5) which extend transversely of the belt 128 and are positioned one after the other in close succession. The rollers 134 may be about ½ inch in diameter and are positioned about as close together as possible. The lower surface of the rollers 134 are tangent to the plane of the two skid plates 130 and 132, and the ends of the rollers 134 are received in bearings located in bearing blocks 136 which are in turn attached to the longitudinal side members 114. Thus, the rollers 134 hold the belt 128 downwardly between the skid plates 130 and 132 while still allowing the flexible belt 128 to assume a slightly undulated configuration. The rollers 134 are formed from a nonmetallic material which is resilient enough to enable them to deflect or spring slightly when subjected to loading transmitted through the belt 128. Plastic having a high content of glass fibers is suitable for this material.

The area immediately below the rollers 134 is called the heating zone, due to the presence of an induction type heating coil 140 immediately above the rollers 134. The conductive element of the coil 140 is formed from copper tubing which is bent into a rectangular configuration. The major axis of this rectangular configuration extends parallel to the belt 128, while the minor axis extends transversely. The copper tubing is connected to a source of cooling water as well as to a source of high frequency alternating electrical current. The cooling water is circulated through the coil 140 to prevent it from overheating. The coil 140 is described in greater detail in U.S. patent application, Ser. No. 570,486 filed Apr. 22, 1975 and now U.S. Pat. No. 4,017,704.

The coil 140 creates a strong magnetic field in the vicinity of the lids L beneath it, and that field reverses polarity at the high frequency of the current. The field causes eddy current losses in membranes M placed within it and this in turn causes a very rapid rise in the temperature of those membranes M. Indeed, due to the nominal thickness of the metal foil in the membrane 17, the rise is almost instantaneous so that within the short span of the rollers 134, the temperature of the membrane M is elevated above whatever temperature is necessary to bond the membrane M to the rim 4 of the container C. For example, if the membrane M is coated with the same material as that from which the container C is made, then the temperature should be high enough to melt that material and thereby form a weld. In the case of polyethylene, that temperature is at least 350° F. On the other hand, if the membrane M is coated with a heat sensitive adhesive, the temperature should be high enough to activate the adhesive and this creates an adhesive bond. The rollers 134, the bearing blocks 136, the skid plates 130 and 132, and the cross members 116 should all be made from a nonmetallic substance such as plastic or glass so that those components will not be heated by the magnetic field.

The main frame 18 has an electric motor on it and that motor is mechanically connected to the drive sprocket 22 of the main conveyor 20, the timing screw 50 of the spacing mechanism 46, the drive roller 126 of the heat sealing assembly, and the powered roller 96 of the lid applicator 90 through suitable chains, gear boxes, and the like to provide the speed relationships previously mentioned.

OPERATION

The machine A receives the containers C after they have been filled with a product, which is usually some type of food product. However, before the containers C are delivered to the machine A, the machine A is provided with a supply of lids L which are loaded into the trough 92 of the lid applicator 80 with their flanges 6 projecting toward the delivery head 86. Moreover, each lid L has a membrane M in it and that membrane M is retained in place by the inwardly directed lip 8 on the flange 6. The rotating rods 94 along the sides of the trough 92 rotate the lids L and thereby cause them to migrate toward the delivery head 86. The leading lid L moves into the upper end of the delivery channel where it is located immediately adjacent the presser finger 91 of one of the air cylinders 90.

The filled containers C are deposited on the plastic table top chain 28 of the main conveyor 20 at random spacing, and this chain moves the containers C forwardly where they accumulate or stack up in single file at the beginning of the timing screw 50 for the spacing mechanism 46 (FIG. 1). The chain 28, being formed from a plurality of interconnected plates, moves easily under the accumulated containers C.

The timing screw 50 engages the containers C one by one and moves them along the conveyor chain 28, releasing them onto the upper pass of the chain 28 at equally spaced intervals. The delivery is such that each container C upon being released moves with the conveyor chain 28 and after a short distance comes between the pair of captivator blocks 68 which are closing immediately beyond the idler sprockets 62 of the captivator assembly 56. Indeed, the opposed blocks 68 grip the side wall 2 of the container C along the concave side faces 70 so that in effect the container C is captured between the opposed captivator blocks 68.

As the captivator blocks 68 approach their fully closed positions, the air cylinder 90 is energized, and causes a lid L to be delivered to the bottom of the delivery channel 88 (FIG. 1). The container C thereupon passes beneath the delivery head 86 of the lid applicator 80 where the rim 4 of the container C comes against that portion of the lid flange 6 which projects from the lower end of the delivery channel 88. Continued advancement of the container C draws the lid L from the channel 88, causing the lid L to drop loosely over the rim 4 of the container C. As the container C passes beneath the powered roller 96, the lid L is forced partially downwardly over the rim 4, such that the flange 6 of the lid L is around the rim 4. The container C thereupon passes beneath compression rollers 98 where the lid L is forced downwardly far enough to cause the lip 8 on its flange 6 to interlock with the rim 4 of the container C. The foil membrane M is of course interposed between the rim 4 and the top surface of the lid L with the foil portion of the membrane M being presented downwardly toward the curved upper surface of the rim 4.

Beyond the compression rollers 98 the captivator blocks 68 diverge, but the container C with the lid L snapped onto it continues to advance on the main conveyor belt 28. Indeed, as the blocks 68 diverge, they force the container C beneath the heat sealing assembly 100, where its lid L comes against the lower pass of the belt 128 (FIG. 3). Thus, the container C is driven at its upper end by a belt 128 and at its lower end main conveyor chain 28. This maintains the same spacing between the containers C, that is the spacing established at the timing screw 50 and maintained through the captivator assembly 56 by the opposed captivator blocks 68.

Upon entering the heat sealing assembly, the container C passes beneath the skid plate 130 (FIG. 3) where the lid L is forced tightly downwardly under a steady pressure. This forces foreign particles from between the membrane M and the curved upper surface of the rim 4 so as to establish a clean seat for the membrane M. This is the prepressing zone. Next the container passes into the heating zone which is beneath the coil 140 and rollers 134. The alternating magnetic field generated by the coil 142 quickly elevates the temperature of the membrane M. Indeed, where a weld is desired the temperature of the membrane M is elevated above the melting temperature for the container C almost instantaneously due to the nominal thickness of the foil layer. While the coil 140 heats the membrane M, the rollers 134 apply an undulating or ripple-like force to the lid L at the annular rib 12 thereon with the ripples moving from the front to the rear of the lid L. In this regard, the belt 128 is quite flexible and tends to deflect upwardly into the spaces between the rollers 134. Hence, the major portion of the force applied to the rib 12 is directly beneath the rollers 134, and since the container C is moving the force at each roller 134 in effect moves from the forward portion of the lid to the rear portion of the lid L. The fact that a plurality of rollers 134 is present creates the undulating or ripple effect. The undulating force causes the heated membrane M to melt the upper portion of the rim 4 on the container C and to further move downwardly into the melted material. Only the portion of the rim 4 located immediately adjacent to the foil membrane M melts, since only the foil membrane M is heated by the coil 140.

Upon leaving the heating zone, the containers C pass into the cooling zone which is directly beneath the skid plate 132. Here the belt 128 is maintained perfectly flat by the plate 132 and forces the lid L downwardly at the annular rib 12. This force is transmitted through the rib 12 to the membrane M which is rolled over the curved upper surface of the rim 4. The force is maintained constant and since no heat is applied, the thin membrane M cools relatively quickly as does the portion of the rim 4 in contact with it. In fact, the rim 4 solidifies and welds to the membrane M, creating a membrane type seal beneath the lid L.

Where an adhesive bond is desired, as opposed to a weld, sufficient current is passed through the coil 140 to raise the temperature above the activating temperature for the adhesive. The rollers 134 acting through the belt 128 and lid L force the membrane M against the rim 4 with the adhesive being interposed between the two.

The machine A enables the containers C to be capped with the lids L and sealed with the membranes M at extremely high speeds. Indeed, speeds up to 300 containers C per minute are possible.

The fact that the containers C are maintained at equally spaced intervals on the main conveyor 20, the chain 28 of which moves at constant velocity, means that the containers C pass beneath the heat sealing assembly 100 at equal time intervals. This is important for otherwise the coil 140 would not operate efficiently, and much worse would either not provide enough heat to effectively seal or else would provide too much heat and thereby scorch the containers C and lids L.

MODIFICATION

Figure 7:
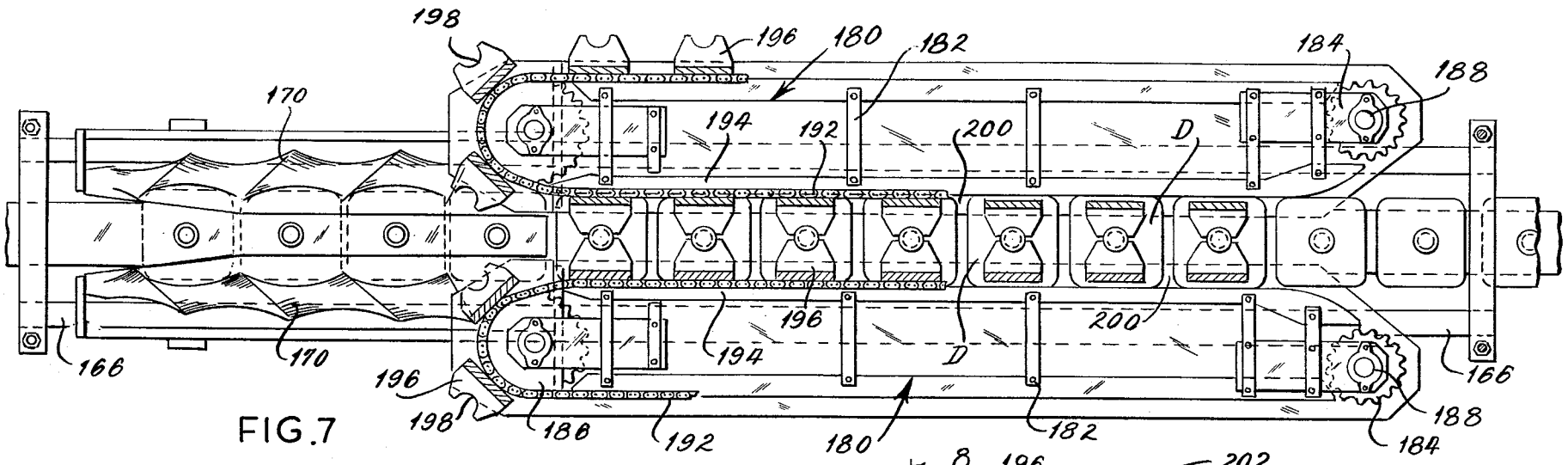
FIG. 7 is a sectional view taken along line 7—7 of FIG. 6.
Figure 6:
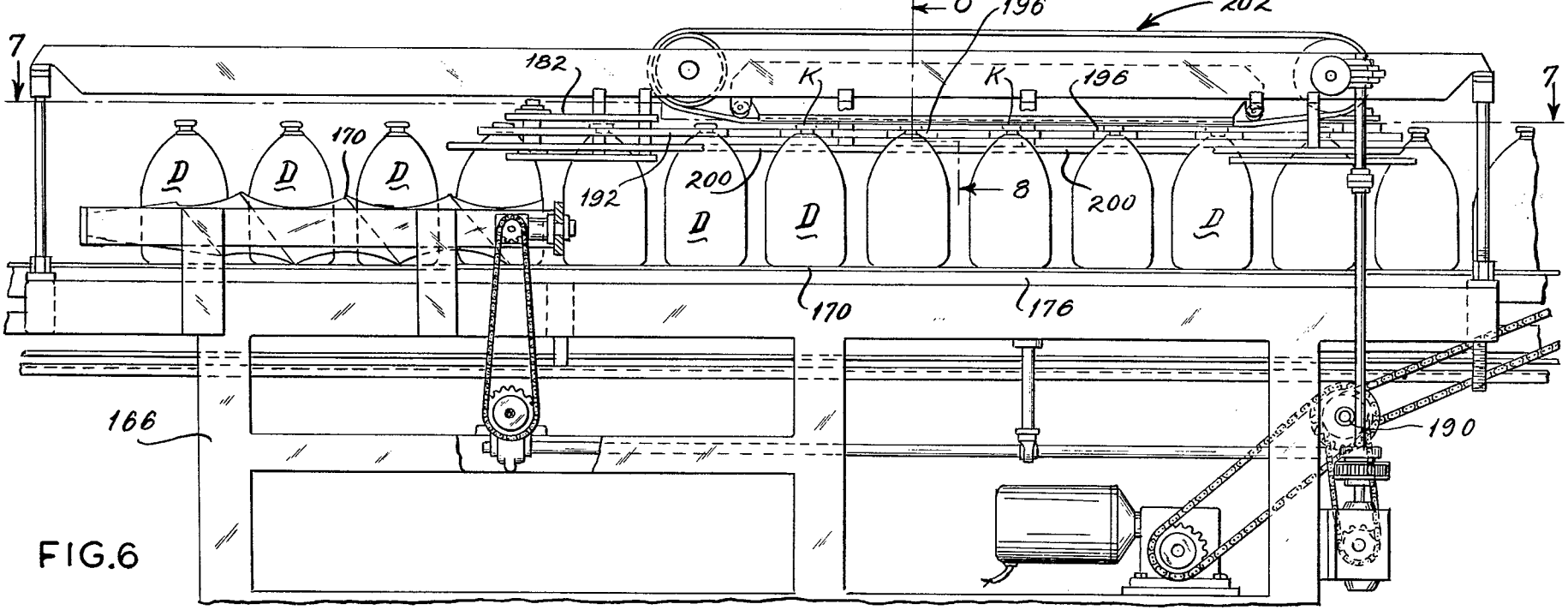
FIG. 6 is an elevational view of a modified capping and heat sealing machine.
Figure 8:
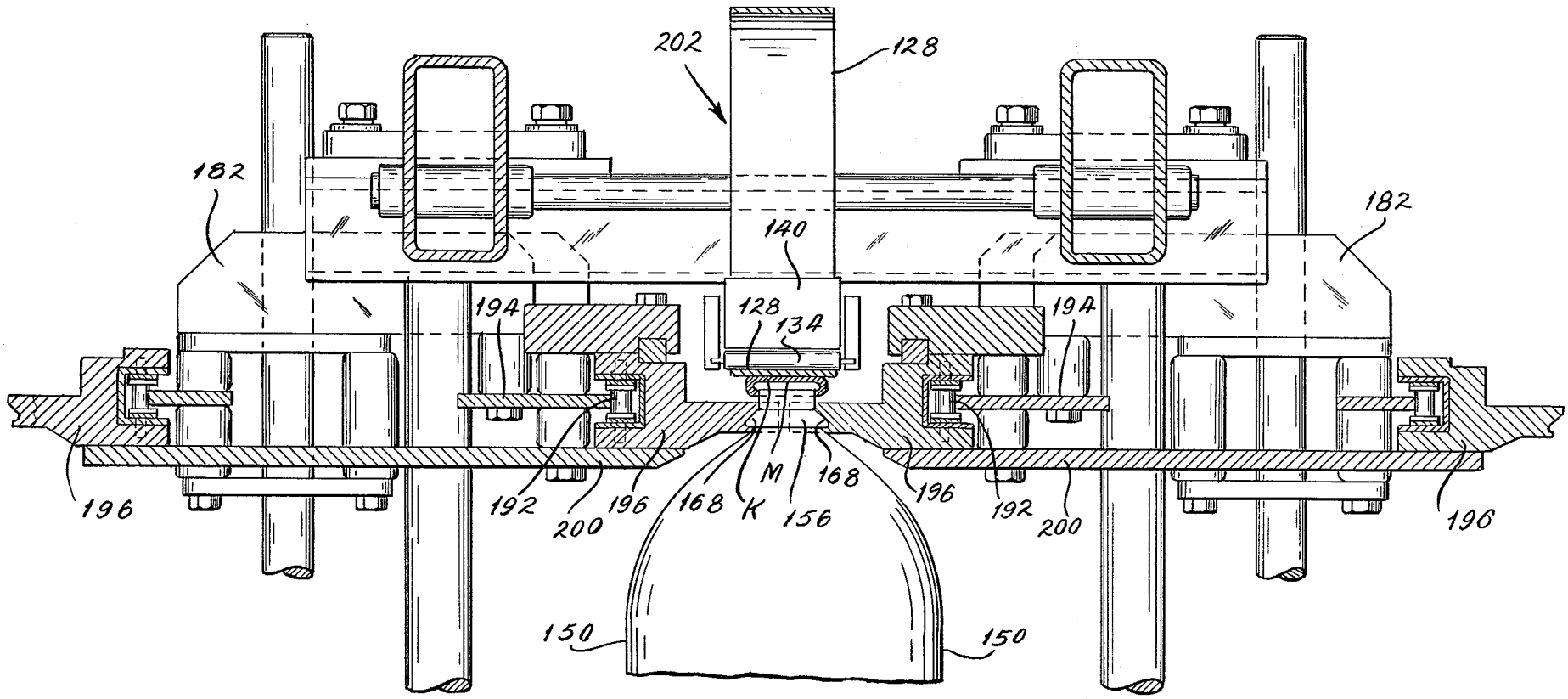
FIG. 8 is a sectional view taken along line 8—8 of FIG. 6 and showing the manner in which the captivator blocks support the containers in the modified machine as the containers pass beneath the heat sealing assembly.

A modified heat sealing machine B (FIGS. 6–8) is quite similar to the machine A, but is more suitable for capping and sealing large containers D, such as milk cartons, having relatively narrow spouts. The principal difference between the machine A and the machine B is that captivator assembly on the latter maintains the containers in a captured condition as they pass through the heat sealing assembly and further resists the downwardly directed force applied by the heat sealing assembly.

Figure 9:
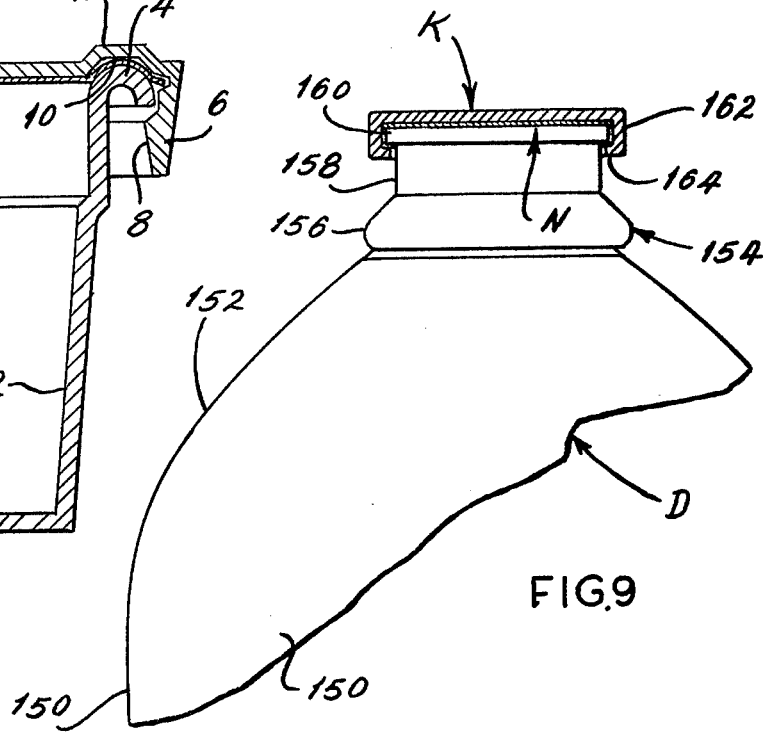
FIG. 9 is a fragmentary elevational view of a container sealed with the modified machine, the cap of the container being in section.

The container D (FIG. 9) has four side walls 150 which impart a square cross-sectional configuration to the container D. The side walls 150 at their upper ends merge into a curved top section 152 which in turn merges into a sprout 154. At its base the spout 154 is provided with an annular rib 156 which projects radially and above the rib 156 has a neck 158 which at its top is provided with an radially directed lip 160. The upper surface of the lip 160 is flat. The container D may be formed from plastic by a blow molding process. The spout 154 is normally closed by a cap K having a downwardly projecting flange 162 at its periphery, and the flange fits over the lip 160 on the neck 158 for the container D. On its inside face, the flange 162 has inwardly directed lip 164 which interlocks with the outwardly directed lip 160 on the neck 158 to retain the cap K in place. The cap K also contains a foil membrane N, the periphery of which is located behind the lip 164 on the flange 162.

The machine B includes a main frame 166 (FIGS. 6 and 7) which supports a main conveyor 168 having a conveyor chain 170 extending from one end of the frame 166 to the other. At the feed end of the conveyor 168 the chain 170 passes over an idler sprocket 172, while at the discharge end it passes over a drive sprocket 174. The chain 170 is of the table top variety with the individual links thereof being plastic plates. The entire upper pass of the belt 170 is supported on parallel skid plates 176 which are carried by the frame 166.

At the feed end of the conveyor 168 the upper pass of the belt 170 is located between counter rotating feed worms 178 (FIG. 7), which are synchronized such that a container D will be accepted in the grooves thereof and advanced the full length of the worms 178, whereupon the container D is released onto the belt 170 such that successive containers D are at equally spaced intervals.

The discharge ends of the worms 178 are located beneath the feed end of a captivator assembly 180 which extends for almost the remainder of the main conveyor 168. The captivator assembly 180 includes an elevated framework 182 (FIG. 6) which is supported above the main frame 166 and this framework 182 has a pair of drive sprockets 184 (FIG. 7) at its discharge end and a pair of idler sprockets 186 at its feed end, with the drive and idler sprockets 184 and 186 of each pair being on opposite sides of the main conveyor chain 170. Each drive sprocket 184 is mounted on a vertical drive shaft 188 and the two drive shafts 188 are tied together and synchronized by a cross shaft 190 which extends under the main conveyor 168. Thus a drive sprocket 184 and an idler sprocket 186 exists on each side of the main belt, and passed around each set of drive and idler sprockets 184 and 186 is a roller chain 192 which is located at about the elevation of the spouts 154 on the containers D. The inside pass of each chain 192 passes along a backing bar 194 which serves as a rigid backing for it. The backing bars 194 converge slightly beyond the idler pulleys 186 and diverge toward the drive pulleys 188.

Each chain 192 has a plurality of captivator blocks 196 mounted on it at equally spaced intervals, those intervals being equal to the spacing imparted to successive containers D by the worms 178. Moreover, the cross shaft 190 synchronizes the two chains 192 such that they not only operate at the same velocity, but such that the blocks 196 of each will be located directly opposite each other when passing over the main conveyor belt 170. The outwardly presented ends of the blocks 196 conform in configuration to the spout 154. In particular, each block 196 has groove 198 (FIG. 8) which opens laterally and is configured to receive the annular rib 156 on the base of the spout 154 so that a portion of the block 196 is beneath the groove 198. When the spout 154 is captured between two opposed blocks 196, the two blocks 196 extend around 90 to 95% of the periphery of the spout 154. Along the inside passes of the chains 192 the blocks 196 ride on underlying plates 200 (FIGS. 6 and 8) which provide subjacent support for the blocks 196 and likewise for the containers D which are captured by them.

As a container D nears the end of the counter rotating worms 178, a pair of captivator blocks 196 passing around the idler sprockets 186 will converge and close upon the spout 154 of the container D. When the blocks 196 are fully closed on the spout 154, the blocks 196 are not only confined in horizontal direction, but in the vertical direction as well, since the blocks 196 in effect interlock with rib 156. The conveyor chain 170 together with the captivator blocks 194, their chains 192, and related apparatus, support and convey the containers D for the remainder of the machine B and are considered conveyor means.

The machine D is provided with a lid applicator (not shown) which is very similar to the lid applicator 80 of U.S. Pat. No. 3,332,209. The delivery head 86 of this lid applicator is located just beyond the point at which the captivator blocks 196 fully close.

The machine D is also provided with a heat sealing assembly 202 (FIGS. 6 and 8) which is very similar to the heat sealing assembly 100 of the machine D. Hence, the heat sealing assembly 202 includes an overhead belt, the lower pass of which parellels the upper pass of the main chain 170 and moves at the same velocity. The overhead belt exerts a downwardly directed force on the caps K as they pass through the prepressing, the heating, and the cooling zones of the heat sealing assembly 202. The downwardly directed force is resisted by captivator blocks 196 which slide along the underlying plates 200. In other words, the force applied to the caps K is not transmitted through the entire length of the container D as is the case with the machine A.

Thus, the relatively tall containers D, which are relatively weak from the standpoint of column strength, are sealed with the modified heat sealing machine B.

This invention is intended to cover all changes and modifications of the example of the invention herein chosen for purposes of the disclosure which do not constitute departures from the spirit and scope of the invention.

What is claimed is:

1. A machine for attaching a seal member to a rim surrounding the open top of a container, the seal member being formed at least in part from metal and being adapted to bond to the rim of the container when heated above a prescribed temperature, said machine comprising: conveyor means for supporting the containers and moving them along a conveying path with the seal members being on the container rims, but initially not bonded to those rims; an induction coil located adjacent to the path and creating a magnetic field in a heating zone through which the seal members and container rims pass as they move along the path, the magnetic field being of sufficient intensity to heat the metal of the seal members above the prescribed temperature; and a succession of closely spaced rollers arranged in a single row extended through the heating zone with their axes extending transversely of the path, the diameter of each roller being substantially less than the length of the seal member measured in the direction of advance for the seal member along the conveying path, each roller being formed from a nonmetallic material and being positioned such that it exerts a downwardly directed force on the seal member of a container passing through the heating zone, the spacing between the rollers being such that a plurality of rollers will concurrently and continuously exert forces on a single seal member as that seal member passes through the heating zone, whereby as the seal member moves through the heating zone and is heated by the induction coil, the succession of rollers causes a ripple-like force to be applied to the seal member and to the rim over which the seal member is disposed to effect a good bond between the seal member and the rim.

2. A machine according to claim 1 and further comprising a flexible belt extending between the rollers and the seal member of a container in the heating zone with the rollers bearing against one face of the belt, the belt moving in the direction of the conveying path and at the same velocity that the conveyor means moves the containers, whereby the ripple-like force is applied to the seal members through the flexible belt.

3. A machine according to claim 1 wherein the conveyor means moves the containers along the path at constant velocity; and wherein the machine further comprises means for spacing the containers at equal intervals along the path, whereby the seal members and container rims over which they are disposed enter the heating zone at equal time intervals.

4. A machine according to claim 2 and further comprising a skid plate located immediately beyond the rollers and backing the belt such that a force is exerted through the moving belt on the seal members, the skid plate being located in a cooling zone in which the seal members are not substantially affected by the magnetic field of the coil, whereby a substantially uninterrupted force is exerted on each seal member as it cools and bonds to the container rim.

5. A machine according to claim 4 and further comprising another skid plate located immediately ahead of the rollers and backing the belt such that a substantially uninterrupted force is exerted through the moving belt on the seal members, said another skid plate being located in a prepressing zone in which the seal members are not substantially affected by the magnetic field of the coil, whereby each seal member is forced against the rim with a substantially uninterrupted force prior to being heated in the heating zone.

6. A machine according to claim 2 and further comprising lid applicator means located along the conveyor means for applying a lid to the container as it moves on the conveyor means, the lid being applied such that the seal member is interposed between the lid and the rim, the lid applicator means being located prior to the heating zone, whereby the rollers exert the ripple-like force through the lids.

7. A machine according to claim 6 wherein the lid applicator means applies the lid to the container with the seal member being carried in the lid, whereby the lid and seal member are placed over the open top of the container simultaneously.

8. A machine according to claim 6 wherein the containers are supported on the conveyor means with their open tops presented upwardly; and wherein the machine further comprises captivator means for gripping the sides of the containers and moving the containers as they are advanced past the lid applicator means.

9. A machine for attaching a seal member to a rim surrounding the open top of a container so as to close and seal the open top of the container, the seal member being formed at least in part from metal and being adapted to bond to the rim of the container when heated above a predetermined temperature, said machine comprising: a main conveyor on which the containers are supported with their open tops presented upwardly; lid applicator means located opposite the main conveyor for applying lids to the containers as the containers move on the conveyor, each lid being applied such that the seal member is interposed between the lid and the rim of one of the containers; means for spacing the containers at equal intervals along the conveyor; captivator means for gripping the sides of the containers and moving the containers past the lid applicator means, the captivator means including front and rear sprockets on each side of the main conveyor, chains passed around each set of front and rear sprockets so that a chain is on each side of the main conveyor, the chains having inner passes which are parallel to the main conveyor, captivator blocks on the chains and having faces which match the contour of the sides of the containers, means for moving the chains at the velocity of the main conveyor with the inner passes moving in the direction of the main conveyor, the means for moving the chains further synchronizing the chains such that captivator blocks on the two chains approach each other beyond the rear sprockets to close upon containers on the main conveyor and are located opposite each other when along the inner passes of the chains, so as to maintain the containers in an upright position on the main conveyor as the lid applicator means applies the lids; an induction coil located opposite the main conveyor after the lid applicator means and creating a magnetic field in a heating zone through which the lids and the container rims pass, the magnetic field being of sufficient intensity to heat the metal of the seal members above the prescribed temperature; and means for forcing the seal members against the rims of the containers as the containers pass through the heating zone, the means for forcing the seal members against the rims including a plurality of closely spaced parallel rollers which are located opposite the main conveyor in a position which enables them to exert an undulating force on the lids and seal members as the containers move past the rollers, and a flexible belt which moves at the same velocity and in the same direction as the main conveyor and rides against the rollers while bearing against the lids so that the force exerted by the rollers on the seal members is exerted through the belt and lids.

10. A machine according to claim 9 wherein the chains of the captivator means extend along the means for forcing the seal members against the container rims.

11. A machine according to claim 10 wherein the captivator blocks are configured to restrain the containers in both horizontal directions as well as the downward direction, and the captivator means further comprises means for providing subjacent support to the captivator blocks as they pass the means for forcing the seal members on the containers, whereby the containers are supported by the captivator means.

12. A machine according to claim 11 wherein the open top of the container is on a reduced spout at the top of the container, and the captivator blocks grip the containers at their reduced spouts.

13. A machine according to claim 12 wherein each spout has an annular rib which projects laterally therefrom and the captivator blocks grip the spouts at their annular ribs, the gripping surfaces of the blocks being contoured to conform to the contour of the ribs in both the horizontal and the vertical directions, whereby the captivator blocks confine the containers in both the horizontal and the vertical directions.

14. A machine according to claim 9 wherein the means for spacing the containers at equal intervals along the main conveyor comprises at least one worm located adjacent to the conveyor ahead of the captivator means to engage the sides of the containers and advance them such that they are released onto the main conveyor at equally spaced intervals.

15. A machine for applying lids to the rims surrounding the open tops of containers and for further bonding membranes to the rims of the containers beneath the lids, the membranes being formed at least in part from metal and being adapted to bond to the rims of the containers when heated above a predetermined temperature, said machine comprising: a frame; a main conveyor on the frame; spacing means for releasing containers onto the main conveyor at equally spaced intervals with the open tops of the containers being positioned upwardly; chains on each side of the conveyor and having inner and outer passes, the inner passes being parallel to the conveyor; captivator blocks on the chains, the blocks having gripping surfaces which conform in configuration to the sides of the containers; means for moving the chains at the same velocity as the main conveyor and with inner passes moving in the same direction as the main conveyor, said means further synchronizing the chains such that the captivator blocks of the two chains as they move toward the inner passes converge and close on a container positioned on the main conveyor so that as the containers move along the inner passes of the chains, they are captured between the opposing blocks on the two chains; lid applicator means for applying lids to the open tops of the containers as the containers are gripped by the captivator blocks, the lids having the membranes contained therein before they are applied so that once the lids are applied, the membranes are interposed between the rims of the containers and the lids; an overhead belt located beyond the lid applicator means and having a lower pass which is parallel to and moves in the same direction and at the same velocity as the main conveyor, the belt being flexible and being positioned to contact the lids of the containers so that the containers are driven from beneath by the main conveyor and from above by the overhead belt; a plurality of closely spaced parallel rollers located behind and backing the belt in the direction transverse to the direction of movement, the rollers exerting a downwardly directed force on the belt, which force is transmitted through the lids, the force on the membranes being of an undulating nature due to the movement of the container and lid beneath the rollers; and an induction coil positioned to create a magnetic field in a heating zone located immediately below the rollers, so that as the containers pass through the heating zone the membranes are heated, the magnetic field being of sufficient intensity to heat the membranes above the prescribed temperature, whereby the membranes bond to the rims of the containers as a result of the heat and force.

16. A machine according to claim 15 and further comprising first means backing the overhead belt immediately beyond the rollers and being located at a cooling zone wherein the magnetic field does not substantially affect the membranes, said first means causing a constant force to be exerted on the membranes as they cool and bond to the container rims.

17. A machine according to claim 16 and further comprising second means backing the overhead on belt immediately ahead of the rollers at a prepressing zone wherein the magnetic field does not substantially affect the membranes, said second means causing a constant force to be exerted on the membranes as they approach the heating zone so as to displace foreign particles from between the membranes and rims before they enter the heating zone.

18. A machine according to claim 17 wherein the first and second means are flat skid plates.

19. A machine according to claim 16 wherein the inner passes of the chains extend past the overhead conveyor and the captivator blocks grip the containers as they pass through the heating and cooling zones, the captivator blocks resisting the force applied by the rollers and first means as the containers pass through the heating and cooling zones.

20. A process for heat sealing a metal foil membrane to the rim surrounding the open top of a container, the membrane being capable of bonding to the rim when raised to a prescribed temperature, said process comprising: placing the membrane over the rim of the container such that the membrane extends across and completely covers the open top; placing a flexible lid over the membrane and engaging it with the container rim, the lid having a downwardly directed flange thereon which extends past the rim of the container and prevents the rim for distorting; thereafter passing the membrane through a magnetic field which undergoes rapid reversals of polarity, the magnetic field being of sufficient intensity to elevate the temperature of the membrane to at least said prescribed temperature; exerting an undulating force on the lid while the membrane is heated in the magnetic field with the force being directed such that it compresses the membrane between the lid and the container rim, the undulating force being a succession of relatively high forces applied simultaneously to the lid in narrow areas which move over the lid from one end to the other end of the lid in the direction in which the membrane passes through the magnetic field with the forces being of sufficient intensity to be transmitted through the lid to the membrane as an undulating force applied to the membrane, the width of each area being substantially less than the dimension of the lid in the direction of advance through the magnetic field; thereafter cooling the membrane; and applying a substantially constant force to the lid as the membrane cools with the substantially constant force being directed such that the membrane is compressed between lid and rim, whereby the membrane bonds to the rim.

21. The process according to claim 20 and further comprising: applying a substantially constant force to the lid prior to subjecting the lid to the magnetic field and undulating force, said prior substantially constant force being directed such that the membrane is compressed between the lid and the rim.

22. The process according to claim 20 wherein the membrane is in the lid when the lid is placed over the container so that the membrane and lid are placed on the container simultaneously.

23. A machine according to claim 1 and further comprising a skid plate located beyond the rollers at a cooling zone and positioned to cause a substantially constant force on the seal elements as they pass through the cooling zone located beyond the heating zone, and wherein the magnetic field does not materially affect the seal elements in the cooling zone so that the seal elements are permitted to cool below the prescribed temperature as the substantially constant force is applied to them.

24. A machine for attaching a seal member to a rim surrounding the open top of a container, the seal member being formed at least in part from metal and being adapted to bond to the rim of the container when heated above a prescribed temperature, said machine comprisng: conveyor means for supporting the containers with the seal members being on the container rims, but initially not bonded to the rims, and for moving the containers such that their rims and the seal members on them pass through a heating zone; an induction coil located at the heating zone and being capable of heating the seal members on those container rims which pass through the heating zone above the prescribed temperature; and means for applying a ripple-like force to the seal members while they are in the heating zone, the ripple-like force being directed toward the container rims so as to press the seal members against the rims while the seal members are above the prescribed temperature, the ripple-like force as to each seal member constituting a succession of closely spaced relatively high force applications applied simultaneously and continuously to the seal member while the seal member is in the heating zone with each force application being applied to the seal member in a narrow area, the width of which is substantially less than the dimension of the seal member in the direction of its advance through the heating zone, so that the force applications move over the seal member in the direction which the container is advanced by the conveyor means, whereby the seal member is bonded firmly to the container rim.

25. A machine according to claim 3 wherein the conveyor means moves the containers such that the container rims pass through the heating zone at constant velocity; and the machine further comprises means for causing the container rims to enter the heating zone at equal time intervals.

26. A machine according to claim 24 wherein the means for applying the ripple-like force comprises a pluraity of non-metallic rollers located in the heating zone opposite to the container rims and the seal members with the axes of the rollers extended transversely to the direction of advance for the container rims through the heating zone.

27. A machine according to claim 26 wherein the means for applying a ripple-like force further comprises a flexible conveyor belt which moves in the same direction that the container rims are advanced and at the same velocity, the flexible conveyor belt being interposed between the rollers and the seal members so that the rollers exert the ripple-like force through the belt.

28. A machine according to claim 24 and further comprising lid applicator means located along the conveyor means for applying lids to the containers moved by the conveyor means prior to the heating zone, the lids prior to being applied to the containers having the seal members contained therein, each lid being applied to its respective container such that the seal member is interposed between the container rim and the lid; and wherein the means for applying the ripple-like force to the seal member on a container exerts that force through the lid.

29. A machine according to claim 24 wherein the conveyor means comprises; front and rear sprockets on each side of the main conveyor, chains passed around each set of front and rear sprockets so that a chain is on each side of the conveyor means, the chains having inner passes which are parallel to the direction of advance for the containers along the conveyor means; captivator blocks on the chains and having faces which match the contour of the sides of the containers; means for moving the chains with the inner passes moving in the same direction, the means for moving the chains further synchronizing the chains such that captivator blocks on the two chains approach each other beyond the rear sprockets to close upon containers located between them and are located opposite each other when along the inner passes of the chains so as to maintain the containers in an upright position.

30. A machine according to claim 29 wherein the chains extend past the heating zone such that the captivator blocks confine the containers as the rims of those containers pass through the heating zone; wherein the captivator blocks are configured to restrain the containers in horizontal directions as well as the downward direction; and wherein the machine further comprises means for providing subjacent support to the captivator blocks as they confine the containers through the heating zone, whereby the containers are at least partially supported by the captivator blocks in the heating zone.

31. A machine for moving a succession of containers while a downwardly directed force is applied successively to each container above its bottom wall, each container having relatively low column strength and ordinarily being incapable of adequately withstanding the downwardly directed force when supported solely on its bottom wall, each container further having a generally peripheral rib intermediate its top and bottom ends with the portion of the container located above the rib being ordinarily capable of withstanding the downwardly directed force, said machine comprising: an underlying conveyor on which the containers are supported in a row with their bottom walls against the underlying conveyor; a rear sprocket on each side of the underlying conveyor; a front sprocket aligned with and located beyond each rear sprocket; chains passed around each set of front and rear sprockets so that a separate chain is on each side of the underlying conveyor, the chains having inner passes which are parallel to each other and to the row of containers; captivator blocks on the chains and being of fixed and determined configuration and at their ends having arcuate grooves, the surfaces of which match the configuration of the peripheral ribs on the sides of the containers, the grooves being located at substantially the same elevation above the underlying conveyor as the peripheral ribs and having the same contour as the ribs in both the horizontal and vertical directions; means for moving the chains at the same velocity and with their inner passes moving in the same direction as the underlying conveyor, the means for moving the chains further synchronizing the chains such that individual captivator blocks on the two chains, after passing beyond the rear sprockets, approach and close upon each other to capture containers on the underlying conveyor with each container being captured between a different pair of captivator blocks, whereby the containers are moved along with the opposed captivator blocks, the configuration of the grooves and their positions with respect to the conveyor when along the inner passes being such that the containers are positively and snugly captured between opposed captivator blocks and are prevented from moving horizontally and also vertically with respect to the blocks; means for applying a downwardly directed force on each container while it is captured at its peripheral rib between opposed captivator blocks; backing means for preventing the captivator blocks from moving laterally away from the containers while along the inner passes of the chains; and means for providing support in the vertical direction for the captivator blocks in the region of the downwardly applied force, whereby the containers are at least partially supported by the captivator blocks as the downwardly applied force is exerted.

32. A machine according to claim 31 wherein the means for providing subjacent support comprises plates over which the captivator blocks slide.

33. A machine according to claim 32 wherein the contoured faces are concave in the vertical direction and conform to the contour of a convex rib on the containers.

* * * * *